US009227132B2

(12) United States Patent
van Rossen et al.

(10) Patent No.: US 9,227,132 B2
(45) Date of Patent: Jan. 5, 2016

(54) SORTING DEVICE FOR SORTING PLAYING CARDS

(71) Applicant: BridgeDrive Products B.V., Oostkapelle (NL)

(72) Inventors: Rogier van Rossen, Schiedam (NL); Sander Martijn Havik, Berkel en Rodenrijs (NL); Maarten Paul Wilming, Gouda (NL); Wouter Erik Sebastiaan Couzijn, Heiloo (NL)

(73) Assignee: BRIDGEDRIVE PRODUCTS B.V., Oostkapelle (NL)

( * ) Notice: Subject to any disclaimer, the term of this patent is extended or adjusted under 35 U.S.C. 154(b) by 0 days.

(21) Appl. No.: 14/381,668

(22) PCT Filed: Feb. 28, 2013

(86) PCT No.: PCT/NL2013/050128
§ 371 (c)(1),
(2) Date: Aug. 28, 2014

(87) PCT Pub. No.: WO2013/133696
PCT Pub. Date: Sep. 12, 2013

(65) Prior Publication Data

US 2015/0035230 A1 Feb. 5, 2015

(30) Foreign Application Priority Data

Mar. 6, 2012 (NL) ..... 1039439

(51) Int. Cl.
*A63F 1/14* (2006.01)
*A63F 1/12* (2006.01)
*A63F 9/24* (2006.01)

(52) U.S. Cl.
CPC ... *A63F 1/12* (2013.01); *A63F 1/14* (2013.01); *A63F 2009/2444* (2013.01); *A63F 2009/2482* (2013.01)

(58) Field of Classification Search
CPC ..... A63F 1/12; A63F 1/14
USPC ..... 273/149 R
See application file for complete search history.

(56) References Cited

U.S. PATENT DOCUMENTS 1,203,261 A * 10/1916 Powers ..... 209/554
2,081,856 A * 5/1937 Frick ..... 211/131.1
2,922,640 A * 1/1960 Fornell et al. ..... 271/289
3,022,891 A * 2/1962 Efram et al. ..... 209/554
3,986,612 A * 10/1976 Kamm et al. ..... 209/587

(Continued)

FOREIGN PATENT DOCUMENTS

WO 2011019800 A2 4/2011

*Primary Examiner* — Michael Dennis
*Assistant Examiner* — Dolores Collins
(74) *Attorney, Agent, or Firm* — Hoffmann & Baron, LLP

(57) ABSTRACT

A sorting device for sorting a stack of playing cards laid in an input bin in four stacks and removing them at the four cardinal points of the sorting device includes two receiving bins disposed on top of each other, of which the upper receiving bins are adjustable in height in order to selectively deposit playing cards in the lower receiving bins or upper receiving bins. The upper receiving bins are disposed on a rotatable subframe that, after sorting, is rotatable for a quarter of a turn in order to bring the upper receiving bins into a removal position in which the playing cards can be removed at the four cardinal points. At the four removal positions, doors are present that open automatically and through which ejector pins then move the playing cards outside.

15 Claims, 5 Drawing Sheets

(56) References Cited

U.S. PATENT DOCUMENTS

| | | | | | |
|---|---|---|---|---|---|
| 4,232,861 | A * | 11/1980 | Maul | 271/287 |
| 5,119,954 | A * | 6/1992 | Svyatsky et al. | 209/584 |
| 5,190,282 | A * | 3/1993 | Rabindran et al. | 271/272 |
| 5,553,712 | A * | 9/1996 | Tisbo et al. | 206/752 |
| 5,706,954 | A * | 1/1998 | Detjen | 209/702 |
| 5,718,427 | A * | 2/1998 | Cranford et al. | 273/149 R |
| 6,726,205 | B1 * | 4/2004 | Purton | 273/148 R |
| 7,537,216 | B2 * | 5/2009 | Soltys et al. | 273/149 P |
| 7,686,151 | B2 * | 3/2010 | Renz et al. | 194/206 |
| 7,726,457 | B2 * | 6/2010 | Maier et al. | 194/206 |
| 7,753,189 | B2 * | 7/2010 | Maier et al. | 194/206 |
| 7,959,153 | B2 * | 6/2011 | Franks, Jr. | 273/148 R |
| 7,976,023 | B1 * | 7/2011 | Hessing et al. | 273/149 R |
| 8,342,526 | B1 * | 1/2013 | Sampson et al. | 273/149 R |
| 8,485,527 | B2 * | 7/2013 | Sampson et al. | 273/149 R |
| 2005/0110210 | A1 * | 5/2005 | Soltys et al. | 273/149 P |

* cited by examiner

SORTING DEVICE FOR SORTING PLAYING CARDS

CROSS-REFERENCE TO RELATED APPLICATIONS

This application is the National Stage of International Application No. PCT/NL2013/050128 filed Feb. 28, 2013, which claims the benefit of Netherlands Application No. 1039439, filed Mar. 6, 2012, the contents of which is incorporated by reference herein.

FIELD OF THE INVENTION

The invention is related to a sorting device for sorting playing cards, comprising an input bin for accepting a stack of cards, transport means for successively discharging the lowest card from the input bin, at least two receiving bins disposed on top of each other, a conveyor track between the input bin and receiving bins, detection means for detecting each card to be discarded and selection means for selectively receiving, depending on the detected detection value, cards transported in the conveyor track in one of the receiving bins, said selection means being formed by adjustment means for adjusting in height at least one of the receiving bins disposed on top of each other.

BACKGROUND OF THE INVENTION

Such a sorting device is known from American patent application US 2005/0110210 A1. In FIG. 5 therein, a sorting device is described with four receiving bins, disposed on top of each other and adjustable in height, for selectively receiving cards transported from the input bin via a common conveyor track to the receiving bins. A disadvantage of said prior art sorting device is that, due to the common conveyor track, all cards must be transported sequentially by the common conveyor track in order to arrive at the selected receiving bin. In order to place the cards in one of the four receiving bins disposed on top of each other, the receiving bins must, in the most unfavorable case, be moved up or down over a considerable distance.

That renders said prior art sorting device relatively voluminous and slow.

SUMMARY OF THE INVENTION

The invention seeks inter alia to provide a sorting device for cards that is compact and can work rapidly.

According to the invention, this is achieved by extending parts of the conveyor track in opposite directions from the input bin and by disposing receiving bins at each end of both conveyor track parts and disposing the detection means in the input bin.

As a result, a card that is being transported from the input bin in an opposite direction to the preceding card, can already be discharged while the preceding card is still under way.

This makes the sorting device even faster.

In a further form of embodiment, rotating means are present to rotate both of the upper receiving bins with respect to the center of the input bin for a quarter of a turn in a horizontal direction, from a first position in which cards can be received in the receiving bins and a second position in which cards can be removed from the receiving bins.

Hereby it is achieved that the cards in the four cardinal points come to lie in the same orientation in the receiving bins, preferably with the longitudinal side of the cards facing the side of the receiving bins where the cards are removed.

If in the four cardinal points of the sorting device doors are present through which, in opened position, cards can be removed from the receiving bins, as well as ejection means that can be activated in the second position of the first subframe for ejecting sorted cards through the opened doors, the removal is made considerably easier.

It will be noted that, from the international patent application WO 2011/091800 A2, a sorting device for sorting playing cards is known with an input bin and four circumjacent receiving bins. In order to transport playing cards selectively from the input bin to one of the receiving bins, the input bin is rotatably disposed in the center of the receiving bins. For each playing card that is to be discarded in another receiving bin, the input bin is rotated in order to discard the playing card in the desired bin.

Due to the repeatedly required rotational movement of the input bin, the sorting process will also last relatively long in this prior art sorting device.

The invention will be further explained below with reference to an example of embodiment of a sorting device, shown in the figures, for sorting cards.

In that connection, other characteristics and advantages of the invention will be explained.

DETAILED DESCRIPTION OF THE INVENTION

Figure 1:
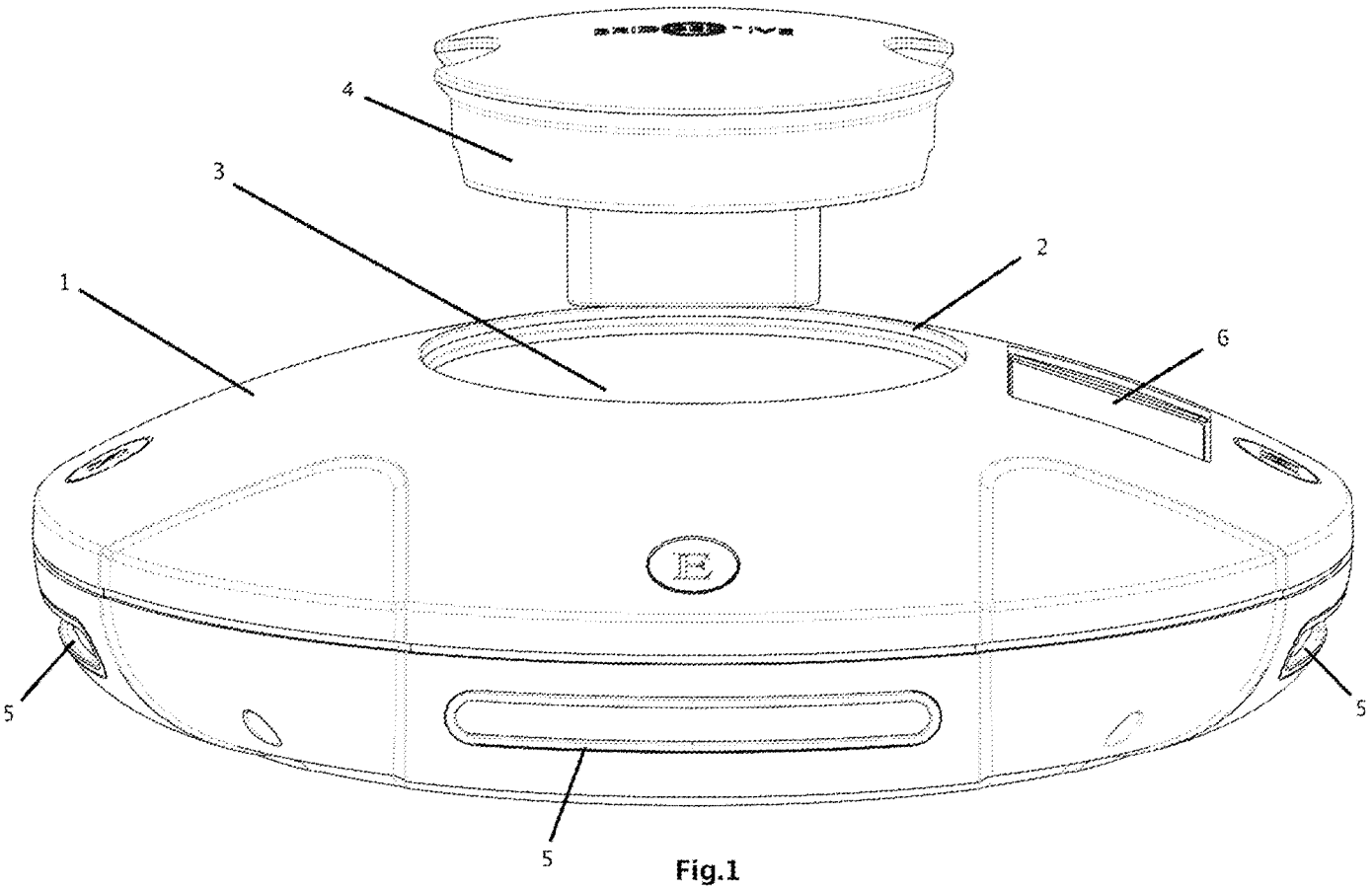
FIG. 1 shows in perspective an outside view of a form of embodiment of a sorting device.

The sorting device shown in FIG. 1 is suitable for sorting playing cards, in particular for the bridge card game. A recess 2 is implemented at the top of the dish-shaped sorting device 1, containing an input bin 3 for inputting a stack of 52 cards.

After inputting a stack of cards, a pressure block 4 is laid in the recess 2 that exerts force on the inserted stack of cards.

Along its circumference, the sorting device 1 is provided with four circularly spaced slots 5. In FIG. 1, one of the slots 5 is clearly visible. The cards sorted by the sorting device 1 are transported via said slots 5 from the sorting device 1 in four stacks of 13 cards each and offered to four card players present around the sorting device in the east, west, north and south positions respectively.

A display 6 is disposed at the top of the sorting device, on which score information of a played bridge game is shown. The sorting device can be connected to a computer in order to input card distributions to be played and to store scores that were realized in the computer.

Figure 2:
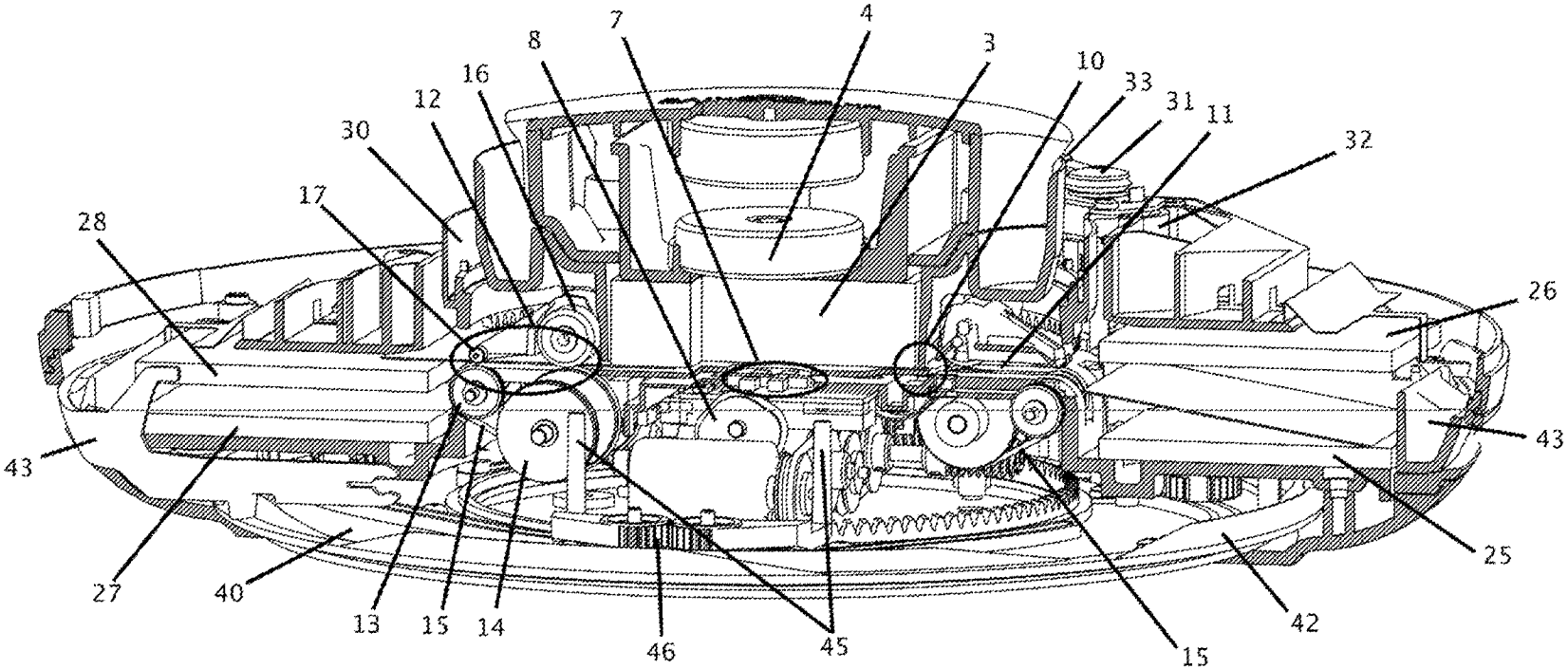
FIG. 2 shows a cut-away view of a sorting device according to FIG. 1, in a position in which cards are sorted.

In FIG. 2, the sorting device is shown in cut-away view, in a position in which a stack of fifty-two cards, laid face down in the input bin 3, is sorted in four stacks of thirteen cards. A sensor array 7, disposed in a recess in the bottom of the input bin 3, can detect a card code on the lowest card of the inserted stack in order to determine which card it is and to which of the four slots, east, west, north or south, the card concerned should be outputted.

Card separation rollers 8, that can be rotatably driven in two opposite directions by a motor 9, are disposed at either side of the sensor array 7 to output the card that in each case is at the bottom of the input bin 3. Cards destined for the east position and for the south position are outputted from the input bin 3 to the right by the card separation rollers 8, visible in FIG. 2, and cards destined for the west position and for the north position are outputted from the input bin 3 to the left by the card separation rollers 8.

A narrow gap 10 at both output sides of the input bin 3, having a height less than the thickness of two cards lying on top of each other, obstructs any second card that may be carried along.

In conveyor tracks 11 and 12 on either side of the input bin 3, identical card transport systems are disposed. Each of said transport systems consists of driven rollers 13 and 14 around which a conveyor belt 15 is mounted. At the location of the rollers 13 and 14 at the beginning and the end of the conveyor tracks 11 and 12, pressure rollers 16 and 17 form conveyor pinchers with the conveyor belt 15.

Figure 3:
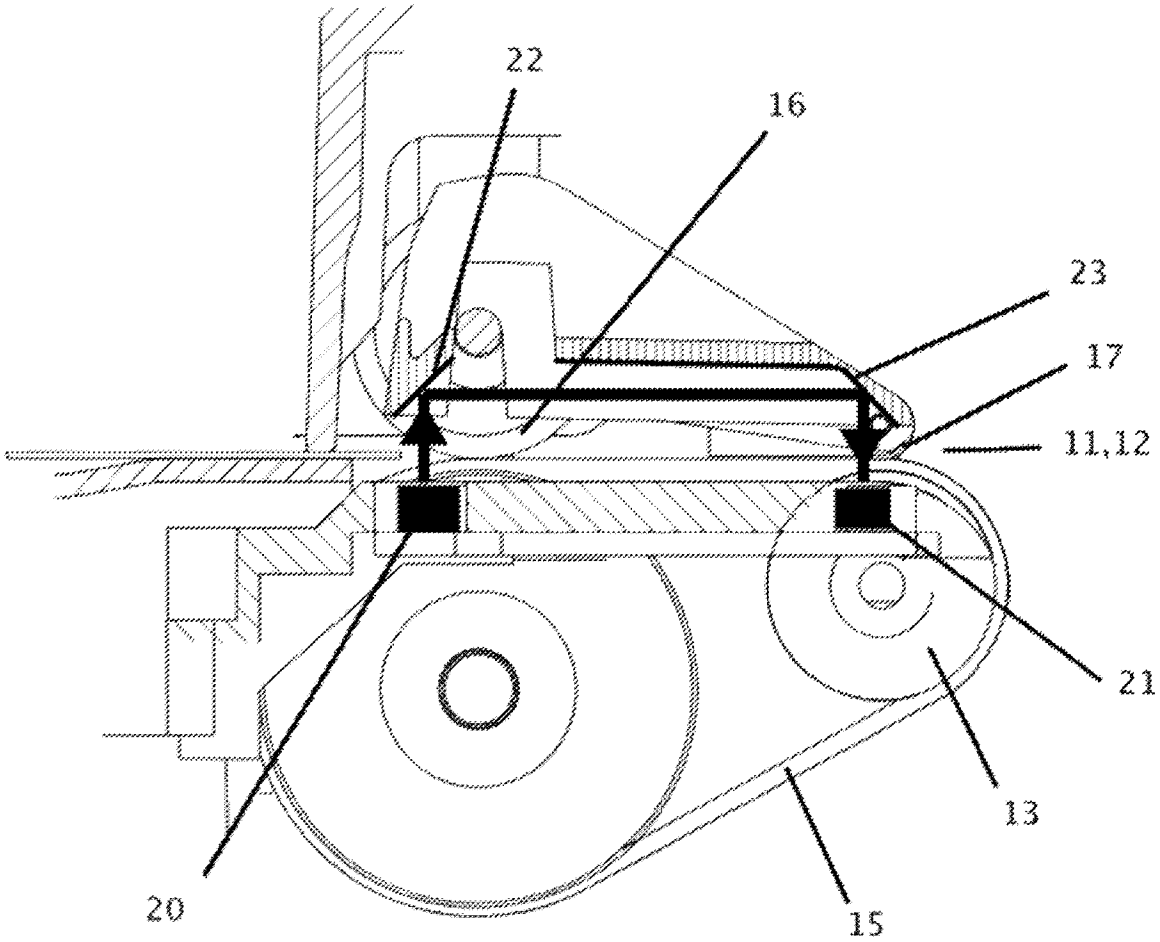
FIG. 3 shows a detection system for cards during the sorting of cards.

A card detector is disposed at the location of the conveyor pinchers, as shown in detail in FIG. 3. This light detector consists of a light transmitter 20 under the first conveyor pincher and a light receiver 21 under the second conveyor pincher and two light-reflecting surfaces 22 and 23, above the first and the second conveyor pincher respectively.

Upon the passage of a card from the input bin 3, transported in one of the conveyor tracks 11 and 12 along the light transmitter 20 at the beginning of each conveyor track 11, 12, the light receiver 21 no longer receives light, indicating that the card concerned has arrived in the associated conveyor track. Upon the passage of the trailing edge of a card along the light receiver 21, the stream of light from the light transmitter 20 to the light receiver is re-established, indicating that the card concerned has been transported from the related conveyor track 11,12 and that a following card can be transported in the associated conveyor track 11,12. If a following card is to be transported in another conveyor track, then said transport can already start earlier, to wit when the preceding card has moved outside the reach of the sensor array 7 in the input bin 3.

As a result, the sorting process can run even faster. By using the light-reflecting surfaces 22 and 23, the light transmitter 20 and the light receiver 21 can both be disposed under the conveyor tracks 11 and 12, contributing towards a lower construction height of the sorting device 1.

As shown in FIG. 2, receiving bins 25 and 26 are disposed at the end of the conveyor track 11, and receiving bins 27 and 28 at the end of conveyor track 12. Receiving bins 25 and 27 are fixedly disposed in the main frame of the sorting device 1 and function as receiving bins for the positions north and south respectively. The receiving bins 26 and 28 disposed above the receiving bins 25 and 27 respectively, functioning as receiving bins for the positions east and west respectively, are mounted on a subframe 30 that is rotatable for a quarter of a turn in a horizontal direction in the main frame around a vertical rotation axis passing through the center of the input bin 3.

Receiving bins 26 and 28 are adjustably mounted in the subframe 30 in vertical direction. To that end, a lift system consisting of a spindle 31 and a nut 32 are present at each of the receiving bins 26 and 28.

On rotation of the spindle 31 by a motor 33 disposed on the subframe 30, the nut 32 and the thereto fixedly connected receiving bins 26 and 28 move up or down respectively, depending on the rotational direction of the associated motor 33.

On the desired output of a card to a bottom receiving bin 25 or 27, depending on the detection value, the associated upper receiving bin 26 or 28 is positioned in its upper position, lying completely above the associated conveyor track 11 or 12, and an outputted card ends up in the lowest receiving bin 25 or 27 respectively.

If a card is to be transported to the upper receiving bins 26 or 28, depending on the detection value, the associated lift system moves the upper receiving bin, 26 or 28, downwards, the associated receiving bin being positioned so far below the associated conveyor track that a card transported therein ends up in the upper receiving bin, possibly on the cards deposited therein earlier.

After completion of the sorting process, in which all 52 cards have been distributed over the four receiving bins, the subframe 30 is rotated a quarter of a turn in order to bring the receiving bins 26 and 28 into the east position and the west position respectively.

Figure 4:
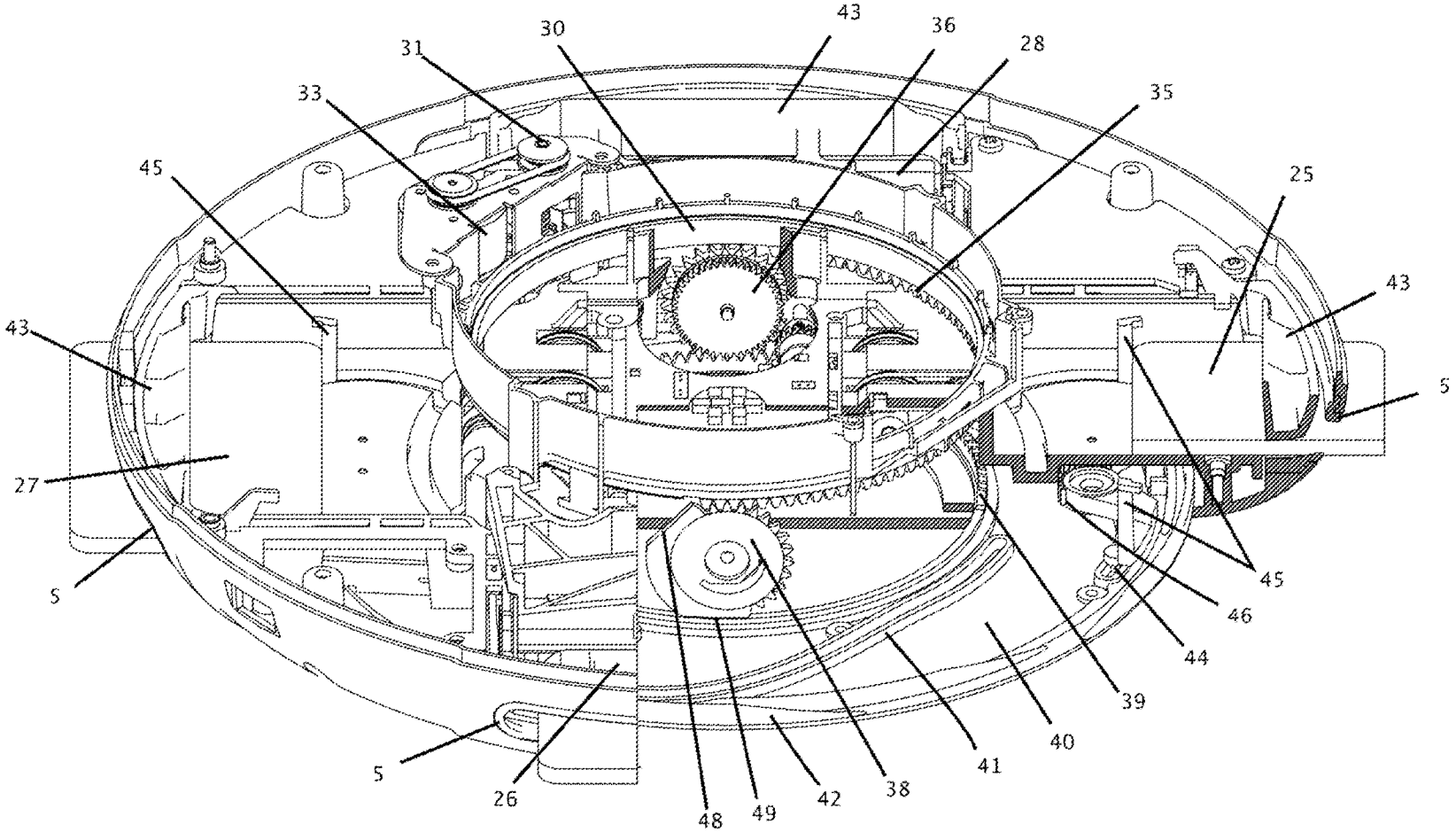
FIG. 4 shows a cut-away view of a sorting device according to FIG. 1, in a position in which sorted cards can be removed.

To this end, as can be seen in FIG. 4, the subframe is provided at its flat bottom with a circularly curved gear rack 35 around the vertical rotation axis of the subframe 30 in the main frame.

A driving wheel 36, fixedly disposed in the main frame of the sorting device 1, brings the subframe 30 into rotation upon being driven by a motor 37, fixedly disposed in the main frame, the receiving bins 26 and 28 coming into the positions shown in FIG. 4.

In this position of the subframe 30, the spindles 31 of both lift systems are activated to bring the receiving bins 26 and 28 into a lowest position that corresponds with the height of the fixedly disposed receiving bins 25 and 27.

A toothed relay wheel 38, fixedly disposed in the main frame diametrically opposite driving wheel 36, is briefly driven at the end of the rotation of the subframe 30 by the gear rack 35.

The relay wheel 38 acts together with a gear rack 39 on the top of a second subframe 40 disposed under the subframe 30. This second subframe 40 is rotatable around the same rotation axis as the first subframe 30. Upon brief rotation of the relay wheel 38, the second subframe 40 rotates anticlockwise and the gear rack 39 comes into contact with the driven wheel 36 that thus further rotates the second subframe 40.

In doing so, the connection between the driving wheel 36 and the first subframe 30 is also broken. The second subframe 40 is provided with four curved runs 41 and four run-up cams 42, one for each cardinal point.

The fixed main frame is provided with four slot-shaped output openings 5 and four swing-up doors 43 that can each close off an output opening. Upon rotation of the subframe 40, the run-up cams 42 force the doors 43 up to their opened position and subsequently move follower pins 44, that each run in a curved run 41, outwards in radial direction.

Two ejector pins 45 at each receiving bin are mutually connected by means of gear wheels 46 and are also connected to a follower pin 44.

By the outward movement of the follower pins 44, the ejector pins 45 also move outward and press the sorted cards in the receiving bins 25, 26, 27 and 28 out through the output openings 5. Upon removing the cards, the doors 43 rest on the cards and fall back into their closed position after the cards are removed.

For the sake of completeness, the whole cycle of the rotation of the subframes 30 and 40 is described in detail with reference to FIG. 4.

Both subframes 30 and 40 each have a gear rack, 35 and 39 respectively, extending over an arc of approximately 180°. The relay wheel 38 has a toothing over half of its circumference. In abutment to the toothing, the relay wheel 38 is provided with slanting surfaces 48 and 49, of which the surface 49, in the position shown in the figure, is in contact with the top of the subframe 40, outside the gear rack 39.

In its initial position the subframe 40 is in a position where the gear rack 39, at the commencement of its toothing, is in contact with the bottom of the toothing of the relay wheel 38. In this connection, surface 48 is in contact with the bottom of the subframe 30, beyond the gear rack 35 on it. In this initial position, gear rack 39 is free of the driving wheel 36 and gear rack 35 is, in its central part, in engagement with the driving wheel 36.

On activation of the driving of the driving wheel 36, the subframe 35 rotates 90° and gear rack 35 engages with the relay wheel 38 and rotates this to a position where surface 49 abuts the subframe 40. In that connection, the gear rack 35 is released from the driving wheel 36 and gear rack 39 is forced into engagement with the driving wheel 36 and is released from the relay wheel 38. Gear rack 39 now rotates 90° anticlockwise up to the position shown in FIG. 4. From this position, the subframes 30 and 40 are rotated back again to their initial positions.

By the operation of the relay wheel 38, the driving of both subframes 30 and 40 is realized by one and the same motor 37. By the operation of the surfaces 48 and 49 on the relay wheel 38, the free rotation of subframes 30 and 40 is prevented. Their movement is blocked as it were, so that undesirable rotation in state of rest, for example during transport, is prevented.

The driving wheel 36 consists of two fixedly and mutually connected gear wheels, one gear wheel driving subframe 30 and the other gear wheel driving subframe 40.

After the removal of the cards, both subframes 30 and 40 return to their initial positions for carrying out a following sorting process.

Figure 5:
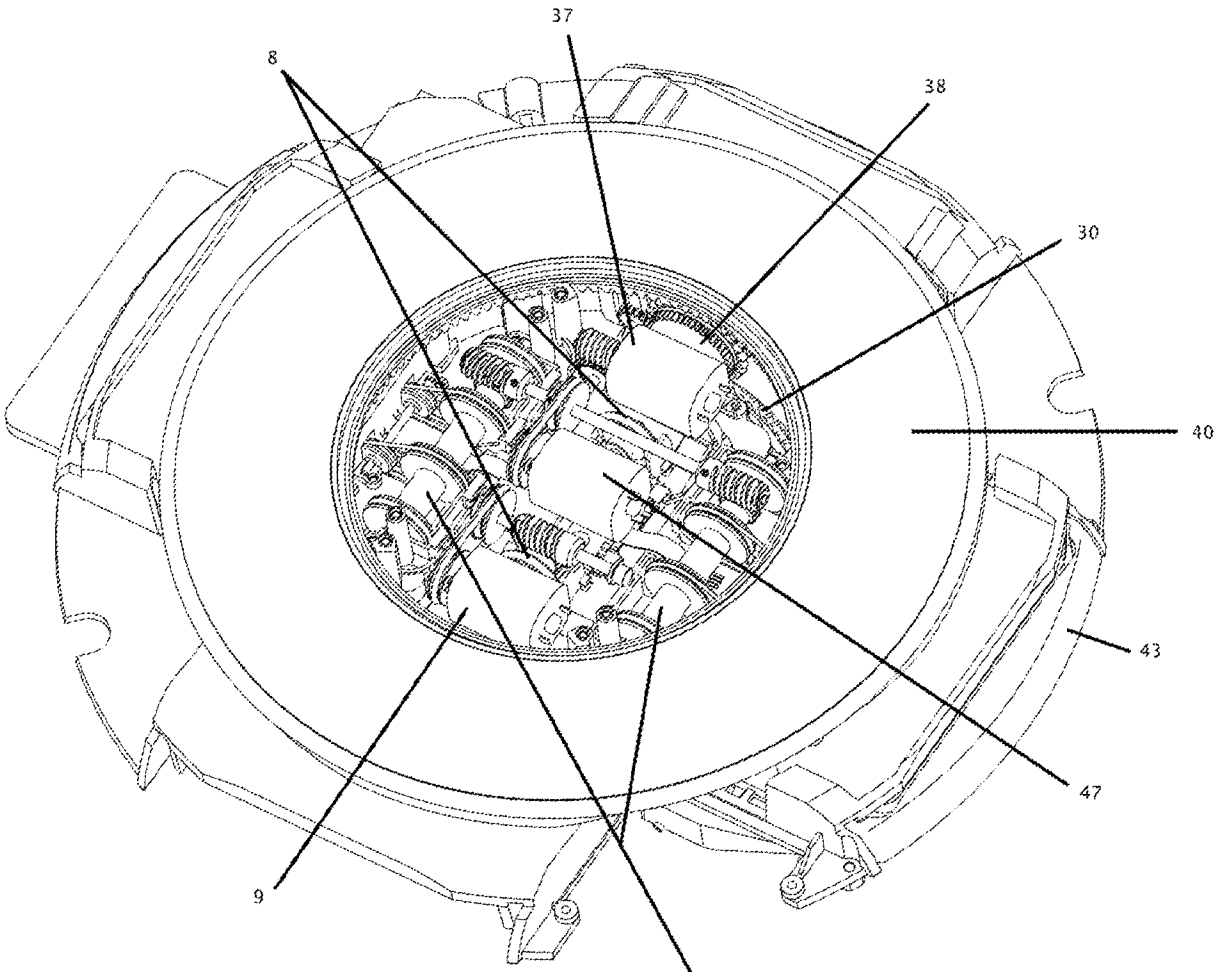
FIG. 5 shows in perspective a bottom view of the sorting device shown in FIG. 1.

FIG. 5 shows, in a bottom view of the sorting device 1, the three motors 9, 47 and 37 for respectively driving the card separation rollers 8, the transport rollers in the conveyor tracks 11 and 12 and the drive system for the subframes 30 and 40.

The sorting process is fastest when many cards are discharged directly after each other in the same receiving bin, and, in the most unfavorable case, is somewhat slower when many cards have to be discharged directly after each other and alternately in the lower and upper receiving bin at the same side of the input bin.

It will be clear that many variations of the sorting device are possible without departing from the scope of protection of the present invention.

The invention claimed is:

1. A sorting device for sorting playing cards, comprising:

an input bin for accepting a stack of cards, transport means for successively discharging the lowest card from the input bin, at least two receiving bins disposed on top of each other, a conveyor track between the input bin and receiving bins, detection means for detecting each card to be discarded, and selection means for selectively receiving, depending on the detected detection value, cards transported in the conveyor track in one of the receiving bins, said selection means being formed by adjustment means for adjusting in height at least one of the receiving bins disposed on top of each other, wherein parts of the conveyor track extend in opposite directions from the input bin and that two receiving bins at each end of both conveyor track parts are disposed on top of each other and that the detection means are disposed in the input bin.

2. The sorting device according to claim 1, wherein, with the aid of adjustment means, the upper of the receiving bins disposed on top of each other is adjustable in height between a first position in which the upper receiving bin lies higher than the conveyor track and a second position in which the upper receiving bin lies lower than the conveyor track.

3. The sorting device according to claim 2, wherein the adjustment means are formed by a drivable spindle, disposed in vertical direction, that acts together with a nut that is fixedly connected with the upper receiving bin.

4. The sorting device according to claim 2, wherein rotating means are present in order to rotate both upper receiving bins with respect to the center of the input bin in horizontal direction for a quarter of a turn from a first position in which cards in the receiving bins can be received and a second position in which cards from the receiving bins can be removed.

5. The sorting device according to claim 2, wherein the upper receiving bins are attached to a first subframe that is rotatable in horizontal direction around a vertical rotation axis through the center of the input bin and that the adjustment means for adjusting the upper receiving bins in height are disposed on the first subframe.

6. The sorting device according to claim 5, wherein the first subframe is provided at its bottom with a circularly curved first gear rack with the vertical rotation axis passing through the center of the input bin as center, said first gear rack being rotatable by a first drivable gear wheel fixedly disposed in the sorting device.

7. The sorting device according to claim 6, wherein the adjustment means for adjusting in height the upper receiving bins in the rotated second position of the upper receiving bins are movable to a lower third position in which the two upper receiving bins lie at the same height as the other receiving bins.

8. The sorting device according to claim 6, wherein the first and the second gear wheel are disposed on one and the same axis between both subframes, that a third freely rotatable gear wheel, that can engage with the first and the second gear rack, is disposed diametrically opposite both drive wheels and that the gear racks have a length and position such that, at the end of the rotation of a quarter of a turn of the first subframe, the freely rotatable gear wheel is rotated by the first gear rack and in turn drives the second gear rack and exerts force on the second drivable gear wheel for rotation of the second subframe, the first gear rack also being released from the first drivable gear wheel.

9. The sorting device according to claim 4, wherein doors are present in the four cardinal points of the sorting device whereby, in their opened position, cards from the receiving bins can be removed.

10. The sorting device according to claim 9, wherein ejection means are present that can be activated in the second position of the first subframe for ejecting sorted cards through the doors.

11. The sorting device according to claim 10, wherein a second subframe is present that is also rotatable in horizontal direction around a vertical rotation axis through the center of the input bin, said second subframe carrying activation means that, on rotation of the second subframe, open the doors at each receiving bin and eject the cards.

12. The sorting device according to claim 11, wherein the second subframe lies under the first subframe and is provided at its top with a circularly curved second gear rack with the vertical rotation axis through the center of the input bin as center, said second gear rack being rotatable by a second drivable gear wheel fixedly disposed in the sorting device.

13. The sorting device according to claim 12, wherein the second subframe is provided with curved runs in each of which, on rotation of the second subframe, a pen is movable in radial direction to operate ejection means coupled thereto, that eject cards lying in the receiving bins.

14. The sorting device according to claim 1, wherein in the parts of the conveyor track that extend in opposite directions from the input bin, a card detector is disposed that, on the one hand, detects when a card comes within reach of the transport means in the associated part of the conveyor track and, on the other hand, detects when said card moves out of reach again of said transport means.

15. The sorting device according to claim 14, wherein the card detector is formed by a light transmitter and a light receiver that, viewed in the direction of transport, are disposed at some distance from each other at one side of the conveyor track, and two light-reflecting surfaces at the other side of the conveyor track that, in the absence of a card, cast light from the light transmitter onto the light receiver.

* * * * *